US006851591B2

(12) United States Patent
Wissman

(10) Patent No.: US 6,851,591 B2
(45) Date of Patent: Feb. 8, 2005

(54) HANG TAG HAVING AN ADJUSTABLE PUSH PAD

(76) Inventor: Larry W. Wissman, 14201 Cameron La., Santa Ana, CA (US) 92705

( * ) Notice: Subject to any disclaimer, the term of this patent is extended or adjusted under 35 U.S.C. 154(b) by 116 days.

(21) Appl. No.: 10/409,714

(22) Filed: Apr. 10, 2003

(65) Prior Publication Data

US 2004/0200872 A1 Oct. 14, 2004

(51) Int. Cl.[7] ..... A44B 21/00

(52) U.S. Cl. ..... 224/604; 24/3.13; 24/3.3; 24/522; 24/527; 224/245; 224/249; 224/257; 224/269; 224/605; 224/678

(58) Field of Search ..... 224/242, 245, 224/247, 249, 257, 269, 603, 604, 605, 616, 617, 678; 24/3.12, 3.13, 3, 3.7; 248/902; 40/658, 667

(56) References Cited

U.S. PATENT DOCUMENTS 2,246,091 A * 6/1941 Forstner ..... 24/3.13
4,128,224 A * 12/1978 Guichard ..... 248/902
4,695,026 A * 9/1987 Medley, Jr. ..... 248/902
4,771,515 A * 9/1988 Guarro ..... 24/3.3
5,033,612 A * 7/1991 Bivins ..... 24/3.3
5,372,345 A * 12/1994 Schmidt ..... 248/902
5,414,906 A * 5/1995 Kren ..... 24/3.3
5,864,924 A * 2/1999 Rodriguez ..... 24/3.3
5,893,198 A * 4/1999 DeCotis ..... 24/3.3
6,076,925 A * 6/2000 Kraut ..... 24/3.3
6,533,414 B2 * 3/2003 Newler ..... 24/3.3
6,564,432 B1 * 5/2003 Kushner ..... 24/3.3
6,598,268 B1 * 7/2003 Zelman ..... 24/3.3

* cited by examiner

*Primary Examiner*—Gary E. Elkins
(74) *Attorney, Agent, or Firm*—Morland C. Fischer

(57) ABSTRACT

A hang tag to be suspended from a chain below the neck or attached to the shirt pocket of a wearer so as to enable the wearer to reliably carry a pair of glasses, or the like, at times when the glasses are not in use such as, for example, while exercising, bathing, enjoying the beach or, in the case of sunglasses, in cloudy conditions. The hang tag includes an elongated body having a longitudinally extending track formed therethrough. A thumb operated adjustable push pad is located in and slidable along the track. One arm of the pair of glasses to be carried is moved through the track and folded over the bottom edge thereof. A pushing force is then applied to the adjustable push pad to cause the push pad to slide axially along the track and into engagement with the hinge that connects the folded arm to the frame of the glasses. Accordingly, the push pad exerts a clamping force on the hinge to prevent the unintended removal of the eyeglasses from the hang tag.

11 Claims, 3 Drawing Sheets

HANG TAG HAVING AN ADJUSTABLE PUSH PAD

BACKGROUND OF THE INVENTION

1. Field of the Invention

This invention relates to a hang tag to be suspended below the neck of a wearer or attached to a shirt pocket of the wearer by which to carry a pair of eye glasses that are not in use. The hang tag has an adjustable push pad to be moved along a track and into engagement with the glasses so as to apply a clamping force thereto and prevent the unintended separation of the glasses from the hang tag.

2. Background Art

It is common for those who wear a pair of eye glasses, sunglasses, goggles, and the like, to find themselves in situations where use of their glasses is not required. By way of example, an individual taking a shower or experiencing cloudy weather conditions may wish to temporarily remove his eye wear. However, the same individual may wish to keep the glasses close to his body to prevent the glasses from becoming lost or misplaced and/or to enable the individual to be able to quickly and easily locate the glasses when their use is once again required.

It may be that the individual is not wearing sufficient clothing to enable him to safely store his glasses when not in use. For instance, those individuals who are visiting the beach in a bathing suit or taking a shower may have no readily available means to store their glasses. Other individuals may not feel comfortable carrying their glasses in a pocket for fear that the glasses might fall out while jogging, exercising or simply sitting on a couch.

Accordingly, there is a need for a convenient and inexpensive means for individuals to safely and reliably carry a pair of eye glasses, or the like, close to their body when not in use so that the glasses will be readily available when needed in the future.

SUMMARY OF THE INVENTION

A hang tag is disclosed by which to enable a pair of eyeglasses, or the like, to be safely and reliably carried close to the body of a wearer when the glasses are not in use. The hang tag includes an elongated body having a clip coextensively connected at the top thereof. The clip has a pair of flexible U-shaped arms that support a tab at the rear of the hang tag. The tab has a spring characteristic so that while at rest, the tab is pressed against the back of the hang tag. In one embodiment, the tab is momentarily pulled away from the rear of the hang tag so that an optional chain can be surrounded and retained by the flexible arms of the clip. In this case, the chain is placed around the neck of the wearer, whereby the hang tag will be suspended from the chain. In another embodiment, the tab is momentarily pulled away from the rear of the hang tag so that a portion of the wearer's shirt pocket can be surrounded and retained by the flexible arms of the clip. In this case, the hang tag will be attached to the wearer's shirt pocket.

A track extends longitudinally through the elongated body of the hang tag. A thumb operated adjustable push tag is located in and slidable along the track. One arm of the pair of glasses to be carried is first moved through the track and then folded over the bottom edge thereof. A pushing force is applied to the adjustable push pad to cause the push pad to slide axially along the track and into engagement to the hinge that connects the folded arm to the frame of the glasses. Accordingly, the push pad exerts a clamping force on the hinge to prevent the unintended removal of the eyeglasses from the hang tag.

DETAILED DESCRIPTION

Figure 1:
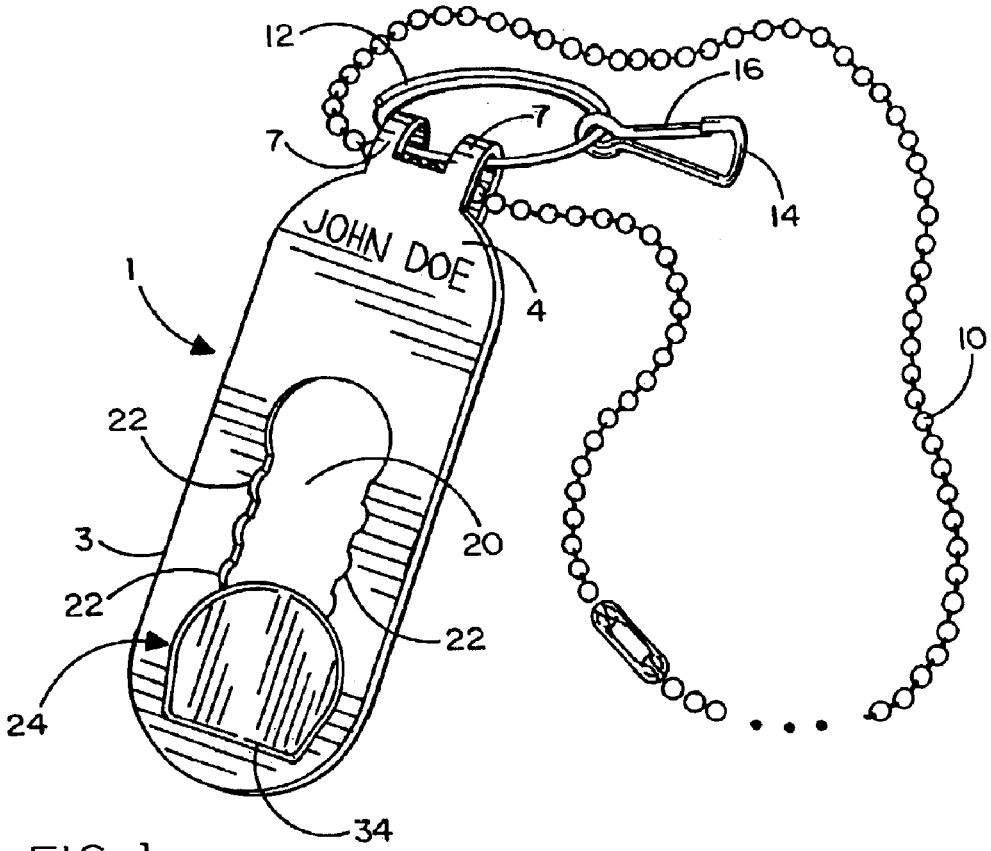
FIG. 1 shows the hang tag and adjustable push pad of this invention having both an optional chain and an optional key ring coupled thereto at an integral clip.
Figure 2:
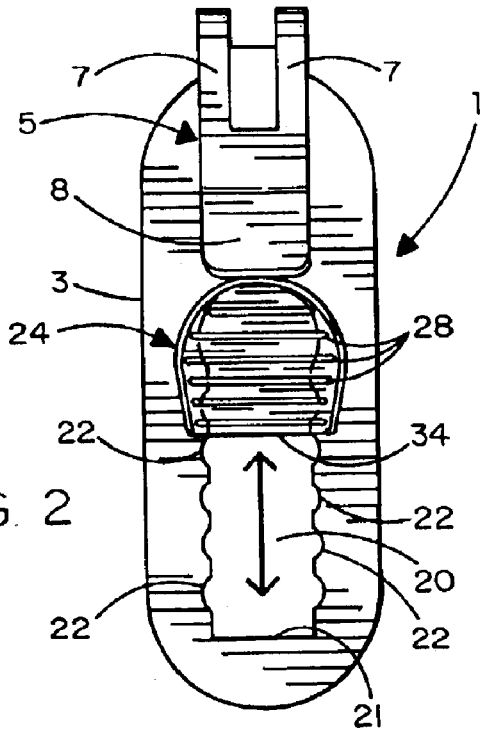
FIG. 2 shows the rear of the hang tag and adjustable push pad of FIG. 1.
Figure 3:
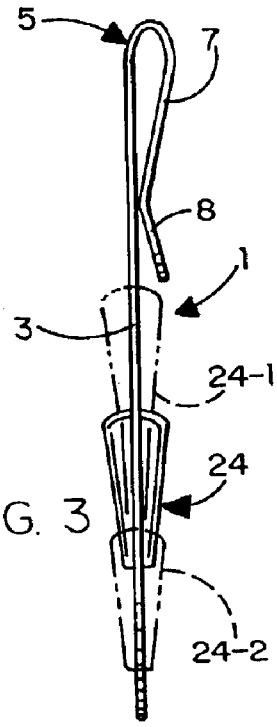
FIG. 3 is a side view of the hang tag and adjustable push pad of FIG. 1.
Figure 4:
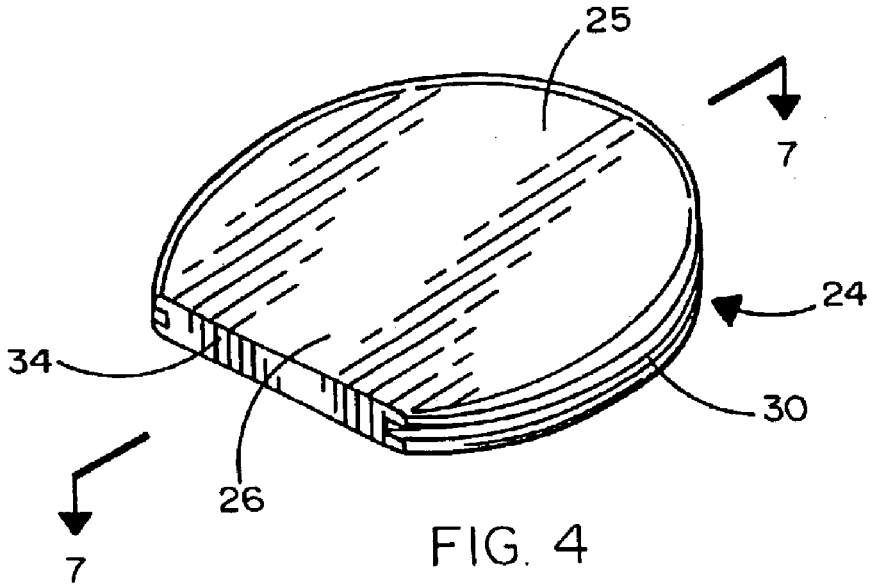
FIG. 4 is a perspective view of the adjustable push pad of this invention to be received in and slidable axially along a track formed through the hang tag of FIG. 1.

The hang tag and the adjustable push pad thereof are initially described while referring to FIGS. 1–3 of the drawings. The hang tag 1 is preferably manufactured from metal (e.g. stainless steel), although the precise material from which the hang tag is manufactured is not to be regarded as a limitation of this invention. The front face of hang tag 1 may have a thin rubber coating applied thereto so as to enable indicia 4 to be printed thereover by means of a conventional rubber silk screen process. The hang tag 1 is shown with an elongated body 3 having a generally oval shape. However, the precise shape of body 3 is likewise not to be considered a limitation of this invention.

A clip 5 is coextensively connected at the top of the elongated body 3 of hang tag 1. The clip 5 includes a pair of flexible U-shaped arm 7 that first project upwardly above the body 3 and then bend downwardly to support a tab 8 at the rear of body 3. With the clip 5 at rest and unstressed, the tab 8 is pressed tightly against the body 3 at the rear of hang tag 1 (best shown in FIG. 3). The clip 5 is provided with a spring characteristic. Because of the flexible nature of the arms 7, the tab 8 may be grasped and pulled away from the body 3 for a purpose that will soon be described. However, when the tab 8 is released and the pulling force terminated, the spring characteristic of clip 5 causes the tab 8 to automatically snap back to its at rest position against the rear of body 3.

FIG. 1 of the drawings shows an optional chain 10 coupled to the hang tag 1 at the clip 5 thereof. In this case, the chain 10 can be worn around the neck of the wearer with the hang tag 1 hanging downwardly therefrom and suspended in front of the wearer's chest (best shown in FIG. 8). The chain 10 is moved into mating engagement with the clip 5 by momentarily pulling the tab 8 away from the body 3 of hang tag 1. The chain 10 is then moved between the tab 8 of clip 5 and the body 3 of tag 1 so as to be surrounded by the pair of flexible arms 7. The tab 8 is then permitted to snap back into contact with the body 3 of hang tag 1. Accordingly, the chain 10 is captured by the clip 5 to prevent the inadvertent separation of the chain from the hang tag 1.

However, the clip 5 may also be used without the optional chain 10 to attach the hang tag 1 to the body of the wearer.

In this case, the hang tag 1 can be carried at the shirt pocket or shirt collar of the wearer (not shown). The manner in which the tab 8 is pulled away from the body 3 of hang tag 1 to permit a section of the wearer's shirt pocket or collar to slide between the tab 8 and the body 3 to be surrounded and retained by flexible arms 7 is identical to the manner described immediately above by which the chain 10 is coupled to hang tag 1.

FIG. 1 also shows an optional key ring 12 coupled to the hang tag 1 at the clip 5 thereof. The key ring 12 is moved into mating engagement with the clip 5 by once again momentarily pulling tab 8 away from the body 3 of tag 1. The manner in which the tab 8 is pulled away from the body 3 of hang tag 1 to permit the key ring 12 to slide between the tab 8 and the body 3 so as to be surrounded and retained by the flexible arms 7 is identical to that described for coupling the optional chain 10 to tag 1.

A clip 14 having a spring-like locking arm 16 (best shown in FIG. 1) is detachably coupled to and carried by key ring 12. The presence of key ring, 12 enables one or more keys, ID cards, and other small objects to be carried alongside the body 3 of hang tag 1 when the tag 1 is either suspended from the wearer's neck (by means of chain 10) or attached to the wearer's shirt pocket or collar (by means of clip 5). The presence of clip 14 enables the hang tag 1 to be suspended from a zipper of the kind that is commonly found on a shirt or sweater.

As an important feature of this invention, a slot or track 20 extends longitudinally through the elongated body 3 of hang tag 1. A set of locking detents 22 runs along each side of the longitudinally extending track 20. The adjustable push pad 24 is received in and slidable axially along the track 20 of body 3. The push pad 24 is sized (e.g. about 20 mm long and 20 mm wide) so as to approximate the size and shape of a human thumb. In this same regard, the width of the track 20 formed through body 3 is sized (e.g. about 15 mm) so as to accommodate the push pad 24 in frictional engagement therewith.

The adjustable push pad 24 is preferably manufactured from rubber (e.g. 380 silicone rubber), although the precise material of manufacture is not to be regarded as a limitation of this invention. A set of spaced, parallel aligned ribs or grooves 28 (best shown in FIG. 2) may be formed across at least one face of push pad 24, whereby to enable the wearer of hang tag 1 to better grip the pad 24 between his thumb and forefinger so as to apply a pushing force thereto for causing the pad 24 to slide along the track 20 for a purpose that will soon be disclosed.

Figure 5:
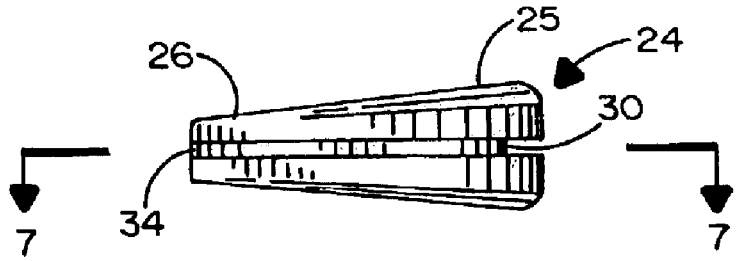
FIG. 5 is a side view of the adjustable push pad of FIG. 4.
Figure 6:
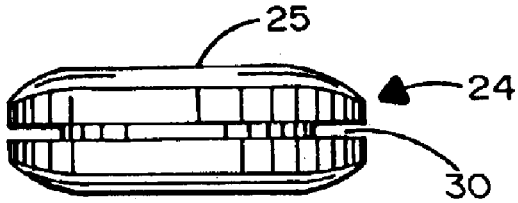
FIG. 6 is a top view of the adjustable push pad of FIG. 4.

The details of the adjustable push pad 24 that is slidably received within and movable along the longitudinally extending track 20 formed through the body 3 of the hang tag 1 are now described when referring concurrently to FIGS. 4–7 of the drawings. As is best shown in FIG. 5, the push pad 24 has a generally triangular profile wherein each of the opposite faces thereof is sloped. That is to say, one end 25 of push pad 24 has a thickness (e.g. 7 mm) which is larger than the thickness (e.g. 3 mm) of the opposite end 26. The resulting triangular profile facilitates the push pad 24 sliding along the track 20 (of FIG. 2) in response to a pushing force that is generated by the thumb and forefinger of the wearer between which the pad 24 is gripped. Moreover, the relatively thin end 26 of pad 24 will be sized to move into receipt by the hinge of most pairs of glasses as will soon be described.

Figure 7:
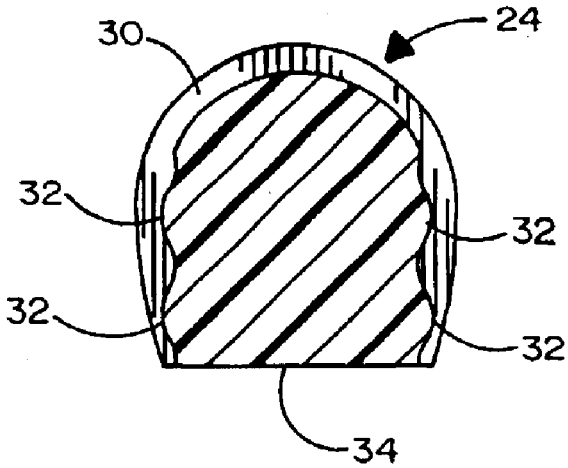
FIG. 7 is a cross-section of the adjustable push pad taken along lines 7—7 of FIG. 4.

A peripheral channel 30 extends around the front and opposite sides of adjustable push pad 24. The purpose of peripheral channel 30 is to receive therewithin the edges of track 20, whereby push pad 24 will be frictionally engaged by the body 3 of hang tag 1. In this regard, and as is best shown in FIG. 7, a pair of ridges 32 are molded into each of the opposite sides of the push pad 24 so as to communicate with the peripheral channel 30. The ridges 32 are sized and shaped so as to fit within respective ones, of the locking detents 22 (of FIG. 2) along the opposite sides of the track 20 through the body 3 of hang tag 1. The engagement of the ridges 32 by locking detents 22 prevents an unintended displacement of the push pad 24 along the track 20.

The adjustable push pad 24 includes a flat stop 34 located across the relatively thin end 26 thereof. The push pad 24 is disposed within the track 20 through the body 3 of hang tag 1 so that the flat stop 34 is aligned to be moved towards the bottom edge 21 (best shown in FIG. 2) of the track 20. The sliding adjustment of the push pad 24 along the track 20 is limited by the engagement of the flat stop 34 against the bottom edge 21 of track 20.

Figure 8:
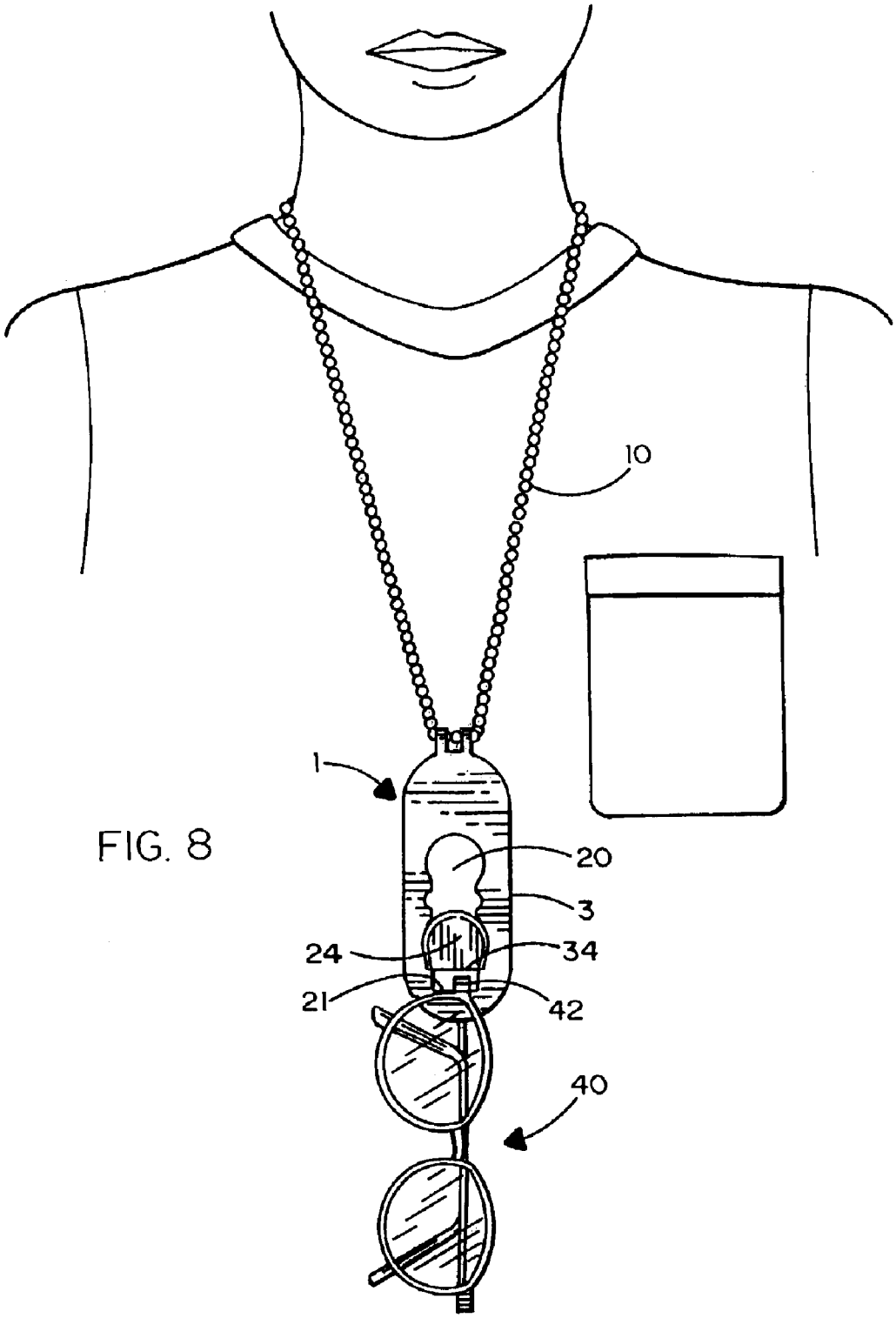
FIG. 8 shows the optional chain of FIG. 1 located around the neck of a wearer with the hang tag and adjustable push pad thereof suspended from the chain for carrying a pair of eyeglasses.

Turning now to FIG. 8 of the drawings, the application of the hang tag 1 and the adjustable push pad 24 thereof is now described, where hang tag 1 is shown suspended below the neck of the wearer by means of the previously described optional chain 10. In the preferred embodiment, the hang tag 1 is used to carry a standard pair of eyeglasses 40 adjacent the wearer's chest. More particularly, one of the arms of the eyeglasses 40 is pushed through the track 20 formed in the body 3 of hang tag 1. The arm is then folded downwardly so that the hinge 42 that connects the arm to the frame of eyeglasses 40 is seated upon the bottom edge 21 of track 20. With the eyeglasses 40 being supported by the hang tag 1 in the manner shown in FIG. 8, the frame of the eyeglasses lies at one side of body 3 and the folded arm lies at the opposite side.

The wearer then grasps the adjustable push pad 24 between his thumb and forefinger and applies a pushing force to cause the pad 24 to slide along the track 20 towards the bottom edge 21 thereof. The push pad 24 is displaced along track 20 from a first position (designated 24-1 in FIG. 3) to a second position (designated 24-2 in FIG. 3) at which point the flat stop 34 at the relatively thin end 26 of pad 24 is moved into interlocking engagement with the hinge 42 of eyeglasses 40. The hinge 42 is now clamped firmly between the flat stop 34 of push pad 24 and the bottom edge 21 of track 20 so that the pair of eyeglasses 40 can be safely and reliably carried by the hang tag 1 while leaving the wearer's hands completely free.

Accordingly, the wearer has a convenient means for carrying a pair of glasses close to his body while, for example, exercising, showering, enjoying the beach or, in the case of sunglasses, in cloudy conditions, whether or not he is wearing ample clothing in which to otherwise place his glasses when not in use. By virtue of the adjustable push pad 24 being slidable along the track 20 that is formed through the body 3, the position of push pad 24 is selectively adjustable to exert a corresponding clamping force on the hinge 42 of the glasses 40 so as to prevent the inadvertent removal of the glasses from the hang tag 1. The ability of the push pad 24 to be adjustably positioned along the track 20 enables any type of eye wear, including goggles, and the like, to be carried by hang tag 1 regardless of the size of the hinge 42. In this same regard, articulated or hinged articles, other than the glasses 40 shown in FIG. 8, may also be located through the track 20 and clamped in place by the adjustable push pad 24 so as to be conveniently carried on the body of the wearer by means of hereinabove disclosed hang tag 1.

I claim:

1. A hang tag by which to carry an article, said hang tag comprising a body, a track formed through said body to receive a portion of the article to be carried, a push pad coupled to said body and slidable along said track so as to move towards and into engagement with the portion of said article in order to apply a clamping force thereto to prevent the removal of the article from said track, and a clip connected to said body to enable said hang tag to be worn by a wearer.

2. The hang tag recited in claim 1, wherein said push pad is manufactured from rubber.

3. The hang tag recited in claim 1, wherein said push pad is sized to receive the thumb of the wearer, such that a pushing force generated by the wearer's thumb causes said push pad to slide along said track and towards the portion of the article received by said track.

4. The hang tag recited in claim 3, wherein said push pad has a ramped face to receive the wearer's thumb thereagainst, whereby the pushing force generated by the wearer's thumb is transferred to said push pad for causing a displacement thereof along said track.

5. The hang tag recited in claim 3, wherein said push pad has a series of ribs formed thereon, whereby the pushing force generated by the wearer's thumb is transferred to said push pad by way of said ribs for causing a displacement of said push pad along said track.

6. The hang tag recited in claim 1, wherein said push pad has a peripheral channel extending therearound, said push pad coupled in frictional engagement to the body of said hang tag at said peripheral channel.

7. The hang tag recited in claim 1, wherein said track has a series of locking detents extending therealong and said push pad has at least one ridge projecting therefrom, the said at least one ridge being removably received in one of said series of locking detents to prevent the displacement of said push pad along said track.

8. The hang tag recited in claim 1, wherein said clip connected to the body of said hang tag includes at least one flexible arm having a spring characteristic, said flexible arm adapted to the attach said hang tag to a shirt pocket of the wearer.

9. The hang tag recited in claim 8, further comprising a chain linked to the body of said hang tag by the said at least one flexible arm of said clip, said chain adapted to surround the neck of the wearer whereby said hang tag is suspended below the wearer's neck by means of said chain.

10. The hang tag recited in claim 8, further comprising a key ring joined to the body of said hang tag by the said at least one flexible arm of said clip, said key ring adapted to carry a key of the wearer.

11. In combination:

a pair of eyeglasses having a frame, a pair of arms pivotally connected to said frame, and respective hinges by which said pair of arms are pivotally connected to said frame; and a hang tag by which to carry the pair of eyeglasses, said hang tag comprising a body, a track formed through said body to receive one of the pair of arms of said eyeglasses, a push pad coupled to said body and slidable along said track so as to move toward and into engagement with the hinge of the said one of the pair of arms of the eyeglasses in order to apply a clamping force to said hinge to prevent the removal of the eyeglasses from said track, and a clip connected to said body to enable said hang tag to be worn by a wearer.

* * * * *